US010245743B2

(12) United States Patent
Compagnone et al.

(10) Patent No.: US 10,245,743 B2
(45) Date of Patent: Apr. 2, 2019

(54) WASTE STRIPPING UNIT WITH SIMPLIFIED TOOL ADJUSTMENT IN A PACKAGING PRODUCTION MACHINE

(75) Inventors: Giovanni Compagnone, Crissier (CH); Glenn Corminboeuf, Belfaux (CH)

(73) Assignee: BOBST SA (CH)

( * ) Notice: Subject to any disclaimer, the term of this patent is extended or adjusted under 35 U.S.C. 154(b) by 1064 days.

(21) Appl. No.: 13/319,408

(22) PCT Filed: May 12, 2010

(86) PCT No.: PCT/EP2010/002930

§ 371 (c)(1),
(2), (4) Date: Nov. 8, 2011

(87) PCT Pub. No.: WO2010/130436

PCT Pub. Date: Nov. 18, 2010

(65) Prior Publication Data

US 2012/0053039 A1 Mar. 1, 2012

(30) Foreign Application Priority Data

May 13, 2009 (EP) ..... 09006447

(51) Int. Cl.
*B21B 31/10* (2006.01)
*B26D 7/18* (2006.01)

(52) U.S. Cl.
CPC ..... *B26D 7/1836* (2013.01); *B21B 31/103* (2013.01)

(58) Field of Classification Search
CPC ..... B21B 31/103; B21B 31/10; B21B 31/08; B26D 7/1836
USPC ..... 72/239; 83/103, 563, 564; 100/228
See application file for complete search history.

(56) References Cited

U.S. PATENT DOCUMENTS

| | | | | |
|---|---|---|---|---|
| 2,899,871 A | | 8/1959 | Auer | 93/36 |
| 3,090,264 A | * | 5/1963 | Stone | B21H 1/02 72/84 |
| 3,204,443 A | * | 9/1965 | Kalberkamp | 72/239 |
| 3,408,886 A | | 11/1968 | David | 83/9 |
| 3,451,244 A | * | 6/1969 | Petros | B21B 31/103 72/239 |
| 3,504,517 A | * | 4/1970 | Clement | B21B 31/10 72/239 |
| 3,643,553 A | | 2/1972 | Morimoto | 93/36 A |
| 3,667,271 A | * | 6/1972 | Fereday | B21B 31/10 49/221 |

(Continued)

FOREIGN PATENT DOCUMENTS

| | | |
|---|---|---|
| EP | 1 057 596 | 12/2000 |
| GB | 745990 | 3/1956 |

OTHER PUBLICATIONS

International Search Report dated Sep. 1, 2010 in corresponding PCT International Application No. PCT/EP2010/002930.

*Primary Examiner* — Kenneth E Peterson
(74) *Attorney, Agent, or Firm* — Ostrolenk Faber LLP

(57) ABSTRACT

A waste stripping unit in a packaging production machine (1), positioned downstream of a cutting unit (3). The stripping unit includes a frame and two rotary tools cooperating with one another (17, 18). A first tool has waste stripping needles protruding radially outward from the outer surface. The two tools (17, 18) are mounted in a removable cassette (22). A frame (23) is provided with bearings supporting the two tools (17, 18), and which can be introduced into, attached to and extracted from the frame (16).

10 Claims, 4 Drawing Sheets

(56) References Cited

U.S. PATENT DOCUMENTS

| | | | | |
|---|---|---|---|---|
| 3,675,456 | A * | 7/1972 | Sieurin | B21B 31/10 72/239 |
| 3,747,387 | A * | 7/1973 | Shumaker | B21B 31/10 72/239 |
| 3,834,291 | A * | 9/1974 | Bishop | 493/373 |
| 4,127,997 | A * | 12/1978 | Quehen | B21B 13/001 72/14.5 |
| 5,941,115 | A * | 8/1999 | Minnerop | B21B 1/12 72/238 |
| 6,098,439 | A * | 8/2000 | Lecrivain | 72/239 |
| 6,397,714 | B1 | 6/2002 | Borel | 83/118 |
| 6,408,667 | B1 * | 6/2002 | de Jesus, Jr. | B21B 31/103 29/401.1 |
| 2002/0078728 | A1 * | 6/2002 | Mukaigawa | B21B 31/103 72/239 |
| 2004/0053761 | A1 | 3/2004 | Georgiades | 493/373 |
| 2004/0182830 | A1 | 9/2004 | Hesterman | 219/121.6 |
| 2005/0092155 | A1 * | 5/2005 | Phillips | B23D 45/068 83/581 |

* cited by examiner

WASTE STRIPPING UNIT WITH SIMPLIFIED TOOL ADJUSTMENT IN A PACKAGING PRODUCTION MACHINE

CROSS-REFERENCE TO RELATED APPLICATIONS

The present application is a 35 U.S.C. §§ 371 national phase conversion of PCT/EP2010/002930, filed May 12, 2010 which claims priority of European Application No. 09006447.8 filed May 13, 2009, the contents of which are incorporated by reference herein. The PCT International Application was published in the French language.

BACKGROUND OF THE INVENTION

The present invention relates to a waste stripping unit for stripping waste obtained by cutting a flat substrate. The invention also relates to a waste stripping unit that facilitates any stripping tool adjustment. The invention also relates to a packaging production machine comprising, in order and in succession, a cutting unit and a waste stripping unit. A packaging production machine is intended for the manufacturing of boxes, which form packaging after folding and gluing. In this machine, an initial flat substrate, such as a continuous strip of cardboard, is unwound and printed by a print unit, itself comprised of subunits in the form of printing units. The strip is then transferred into a cutting unit.

After cutting, the blanks obtained have areas of waste that are separated and discarded into a waste stripping unit, so as to be able to then create boxes after the waste is removed. The blanks are then separated in a separator to obtain individualized boxes.

The unit for stripping of these wastes is mounted after the cutting unit. The stripping unit ensures a precise and rapid stripping of wastes. The precision of operation of the stripping unit also makes it possible to avoid having waste cause jams.

The stripping unit comprises two tools, in the form of two rotary cylinders, positioned parallel to one another, so as to cooperate with one another. The blanks travel through a gap between the two cylinders following a substantially horizontal path.

One of the cylinders, the bottom cylinder, has radial needles which are pressed into each piece of waste. The needles separate the wastes from the blank by carrying them away with the rotation of the needle cylinder. These waste pieces are then removed from these radial needles during the rotation of the cylinders. Ejectors in the form of immobile combs are arranged parallel to the cylinders. The radial needles are thus freed of waste and will be pressed into other wastes when they next pass into the cutting area of the next blank.

The other cylinder, the top cylinder, has on its surface either strips made of a flexible material, for example foam, arranged in successive rings spaced apart, or a single strip forming a complete covering made of a flexible material, for example of vulcanized rubber type. Holes are pierced in the cylinder outside the areas covered by the foam strips or in the vulcanization layer, depending on the version. The position of the holes corresponds to that of the needles. These needles are accommodated in the holes as the two cylinders rotate, to ensure that the needles effectively pierce through the waste pieces. The top cylinder transports the blanks and holds them when the waste is spiked.

STATE OF THE ART

The documents U.S. Pat. No. 2,899,871 and EP-1,057,596 give examples of cut waste stripping systems.

However, the operations involved in changing stripping cylinders prove to be lengthy and tedious. The users want to be able to make extremely rapid job changes by modifying the stripping cylinders, in order to address the increasingly exacting demands of their customers for printing and cutting in small series.

First of all, and as soon as the machine has been stopped, the operator mechanically disconnects the needle-holding cylinder to remove it from its drive mechanism. Then, the operator takes the cylinder out of the stripping unit, and out of the machine. Next, the operator precisely introduces the stripping needles one after the other in drill-holes provided in the surface of a new cylinder, according to a pattern representing the blank. Finally, the operator replaces the new cylinder in the stripping unit by reconnecting it to its drive.

However, this operation takes a long time, because of the need to disconnect and then reconnect all the mechanical links for driving the cylinders. During this time, all machine production is stopped.

Furthermore, the positions of the two cylinders must be accurate in the waste stripping unit. Not only are the two cylinders adjusted relative to one another, but also both are adjusted relative to the frame of the unit. In both cases, the spacing, the parallel alignment and the relative orientation in the horizontal and vertical planes, between the two cylinders, have to be set.

The weight of a cylinder is 30 kg to 50 kg, or even up to 900 kg in the case of a bottom cylinder with needles associated with a top cylinder with cutting blades. To take the cylinder out, the operator lifts it using a hoist.

Because of the fairly heavy weight, a change of cylinder cannot be performed very quickly. Job changes, and thus tool changes, are necessary to obtain numerous different boxes. The frequent cylinder handling operations thus take a long time and are tedious.

The cylinder spiked with needles presents an injury danger to the operator. Nevertheless, this cylinder, when ready to use, has to be handled to be replaced in the waste stripping unit.

EXPLANATION OF THE INVENTION

A main objective of the present invention is to develop a waste stripping unit positioned downstream of a cutting unit for a packaging production machine. A second objective is to produce a waste stripping unit that allows the stripping tool or tools to be prepared outside the machine, without the machine having to be stopped. A third objective is to simplify and facilitate any change of one or more stripping tools. A fourth objective is to optimize the precision for stripping the wastes. Yet a fifth objective is to obtain a stripping of wastes that avoids the problems of the state of the art. Yet another objective is to provide a packaging production machine with a waste stripping unit integrated after an upstream cutting unit and that offers a wide flexibility of use.

In a first aspect, the present invention relates to a waste stripping unit in a packaging production machine, which is positioned downstream of a cutting unit. The waste stripping unit comprises a frame and two rotary tools cooperating with one another. A first tool is provided with waste stripping needles protruding radially outward from its outer surface. The two tools are mounted in a removable cassette, comprising a frame provided with bearings which support these two tools, and which can be introduced into, fixed to and extracted from the frame.

In other words, with a cassette, the operator will be able to prepare the waste stripping tools outside the waste stripping unit, and thus outside the packaging production machine. The cassette enables the operator to easily prepare the waste stripping unit for the ensuing job, according to the requirements, i.e. according to the position of the wastes present at the level of the blanks and/or of the boxes.

The installed cassette that has served its purpose is extracted from the unit, and thus from the machine. A new cassette, prepared in advance, is then immediately introduced into the stripping unit. When the machine is once again in production, the removed tools and cassette that have served their purpose are dismantled and again prepared for a subsequent use. The machine downtimes are thus reduced to the absolute minimum, with only the time it takes to change cassette.

The stripping unit, with its tool preparation steps, is no longer an element used for transforming the flat substrate or substrates that slows down all the packaging production. With two interchangeable cassettes, a first cassette being in production and a second cassette being in preparation, the operation of the waste stripping unit can continue almost uninterrupted.

The cassette and its frame are dimensioned appropriately and their ergonomics are suited to its introduction into, its attachment to and its extraction from the frame of the waste stripping unit, so it is able to be handled by a single operator.

In another aspect of the invention, a packaging production machine comprises the waste stripping unit having one or more of the technical features described hereinbelow and claimed, positioned downstream of a cutting unit.

The upstream and downstream directions are defined with reference to the direction of displacement of the substrate, following the longitudinal direction in the waste stripping unit and throughout the packaging production machine. The longitudinal direction is defined with reference to the direction of displacement of the flat substrate in the waste stripping unit and in the machine, along its median longitudinal axis. The transverse direction is defined as being the direction perpendicular to the direction of displacement of the flat substrate. The front and rear positions are defined relative to the transverse direction, as being, respectively, the operator's side and the opposite operator's side.

According to yet another aspect, the invention relates to a waste stripping cassette for a waste stripping unit. The unit is positioned downstream of a cutting unit for cutting one or more flat substrates in a packaging production machine. The cassette comprises a frame provided with bearings, supporting two rotary tools cooperating with one another. A first tool is provided with waste stripping needles protruding radially outward from the outer surface. The cassette can be introduced into, attached to and extracted from a frame of the waste stripping unit.

BRIEF DESCRIPTION OF THE DRAWINGS

The invention will be better understood and its various advantages and different characteristics will become more apparent from the following description, of the nonlimiting exemplary embodiment, with reference to the appended diagrammatic drawings, in which.

DETAILED EXPLANATION OF PREFERRED EMBODIMENTS

Figure 1:
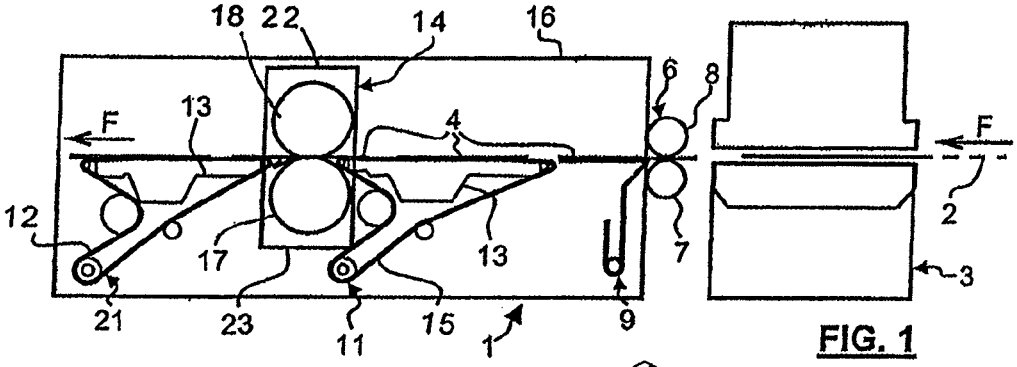
FIG. 1 represents a synoptic side view of a packaging production machine equipped with a waste stripping unit.

As FIG. 1 shows, a packaging production machine (1) processes a substrate or a material in a continuous strip (2), which is in this example flat cardboard. The machine (1) comprises a transformation unit, for example a diecutting platen press (3). Upstream of that press (3), the machine (1) may have units such as printing units, means for checking quality and register, embossing units, etc. (not shown).

The strip (2) enters into the press (3) from its upstream transverse side. The press (3) cuts the strip (2) and delivers the substrate in the form of blanks (4), made of flat cardboard. The blanks (4) leave the press (3) by its downstream transverse side. The direction of progress or of advance (arrows F) of the strip (2) and of the blanks (4) in the longitudinal direction indicates the upstream direction and the downstream direction.

The machine (1) includes a drive arrangement (6), which is arranged downstream of the press (3). This arrangement (6) firstly comprises a bottom drive roller (7), driven in rotation by a motor. The arrangement (6) then comprises one or a series of small pressure rollers (8), arranged above and bearing against the roller (7). The blanks (4) are engaged, held and driven between the roller (7) and the small roller or rollers (8). The arrangement (6) ensures an active transfer of the blanks (4), so as to release the blanks (4), in succession one after the other, out of the press (3), in the longitudinal direction (F), from upstream to downstream.

The machine (1) comprises a transfer device (9) for the blanks (4). The device (9) is intended to transfer downstream the blanks (4) in succession one after the other, from the arrangement (6), in the longitudinal direction (F).

The machine (1) comprises a first transport assembly, which is more specifically a first vacuum transport (11), and which is arranged downstream of the transfer device (9). This first vacuum transport (11) comprises a conveyor with one or more endless belts with orifices (12). A vacuum chamber (13), connected to a vacuum source, presses the blanks (4) against the belt (12).

The blanks (4) are arranged on the top face of the belt (12), one after the other, with a short interval between them. The first vacuum transport (11) ensures an active transfer of the blanks (4). The belt (12) drives the blanks (4), in the longitudinal direction (F), from upstream to downstream.

The machine (1) then comprises a waste stripping unit (14), which is placed downstream of the press (3) and after the first vacuum transport (11). This unit (14) allows for the controlled elimination of the cardboard wastes which are precut from the blanks (4).

A duct for the evacuation of the waste (15) leaves from the rear (see FIGS. 4 and 5) of the waste stripping unit (14). In this example, this evacuation is thus done by suction. The waste stripping unit (14) comprises a supporting structure or a frame (16).

Advantageously, the unit (14) may include the first transport assembly for the blanks (4), i.e. the first vacuum transport (11). The transfer device (9) and this first vacuum transport (11) can advantageously be mounted in the frame (16) which is dimensioned accordingly.

The central portion of the unit (14) comprises a first, cylindrical, bottom rotary tool (17), cooperating with a second, cylindrical, top rotary tool (18). The two tools (17 and 18) are mounted, parallel to one another, one above the other, and transversely to the frame (16), and thus to the unit (14). The first transport assembly, i.e. the first vacuum transport (11), may be placed upstream of the two rotary tools (17 and 18).

The bottom tool (17) is provided with radial needles (not shown in the Figures) which protrude radially toward the top tool (18). These needles are positioned appropriately on the surface of the bottom tool (17) at the places where the cutting of the strip (2) produces wastes. Thus, these needles are spiked into each of the waste areas, so as to be able to eliminate the waste using combs mounted in proximity to the bottom tool (17).

Figure 2:
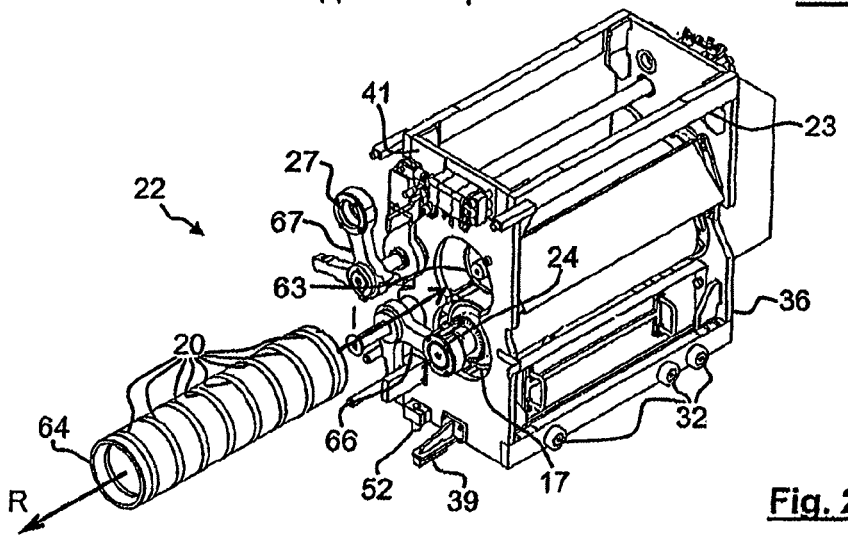
FIG. 2 represents a perspective view of a waste stripping cassette, according to the invention, with a mandrel of one of the two tools in the extracted position.

Favorably, the top tool (18) can be provided (as can be seen in FIG. 2) with at least one strip of a foam-type flexible material (20). This strip or these strips may protrude radially outward, toward the bottom tool (17). These strips (20) are positioned on the surface of the top tool (18) at the places where there are no corresponding needles.

The machine (1) comprises a second transport assembly, which is, more specifically, a second vacuum transport (21), and which is arranged downstream of the waste stripping unit (14). The second transport assembly (21) is substantially similar to the first transport assembly (11), with endless belts with orifices (12) and a vacuum chamber (13).

The unit (14) may comprise this second transport assembly for the blanks (4), i.e. the second vacuum transport (21). This second vacuum transport (21) may be placed downstream of the two rotary tools (17 and 18). The second transport assembly (21) may be mounted in the frame (16).

The machine (1) then comprises a separator (not represented), which is arranged downstream of the waste stripping unit (14), after the second transport assembly (21). The nicks present on the blanks (4) and between the boxes are broken by the separator, and the blanks (4) are thus transformed into boxes.

Figure 3:
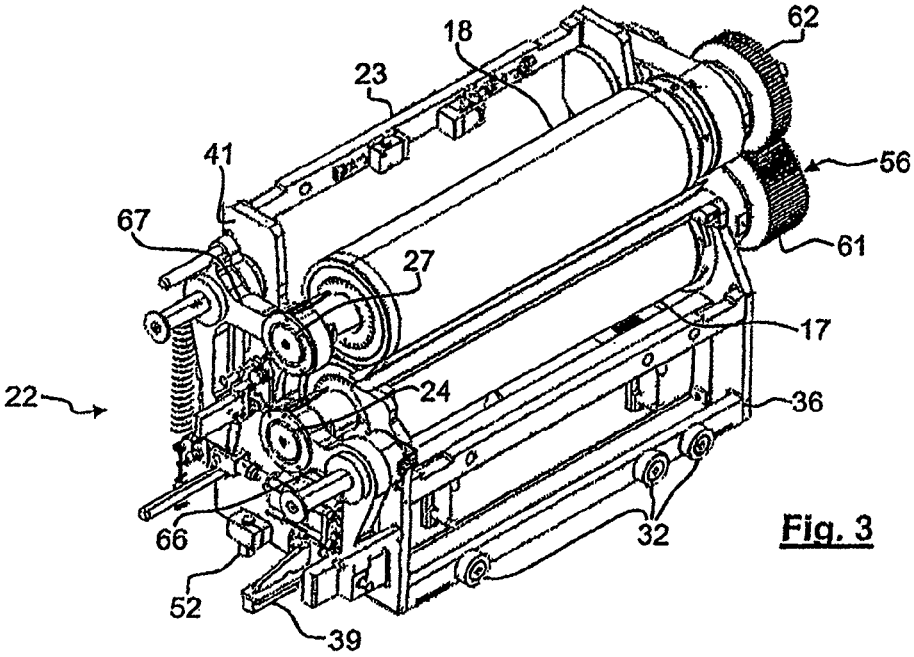
FIG. 3 represents a perspective view of a waste stripping cassette, according to a second alternative embodiment.

According to the invention, the waste stripping unit (14) comprises a removable cassette (22). In its initial alternative (FIGS. 2, 4 to 6 and 8) or in the second alternative embodiment (FIGS. 3 and 7), the removable cassette (22) can be introduced (arrow E in FIG. 4) into the frame (16), to be fixed to the frame (16), and, conversely, to be detached and to be extracted (arrow O in FIG. 5) from this frame (16). In this favorable embodiment, the first vacuum transport (11) is placed upstream of the cassette (22), and the second vacuum transport (21) is placed downstream of the cassette (22).

The removable cassette (22) comprises a supporting structure or frame (23). As seen in FIGS. 2 to 6, the frame (23) is provided with a bottom front bearing (24) and a bottom rear bearing (26) supporting the first tool, i.e. the bottom tool (17). The frame (23) is provided with a top front bearing (27) and a top rear bearing (28) supporting the second tool, i.e. the top tool (18).

The unit (14) may preferentially include a transverse housing (29) formed in the frame (16). The housing (29) is formed between the first transport assembly (11) and the second transport assembly (21). The cassette (22) can be introduced (E) transversely relative to the frame (16) into this transverse housing (29). Conversely, the cassette (22) can be extracted (O) transversely relative to the frame (16) out of this transverse housing (29).

For the displacement (E and O) of the cassette (22), two parallel and substantially horizontal rails (31) are mounted transversely to the frame (16), between the front and the rear of the unit (14), and on either side of a bottom part of the transverse housing (29). The cassette (22) is equipped with small rollers (32), placed at the bottom transverse uprights of the frame (23). By virtue of these small rollers (32), the cassette (22) rolls (E and O) along the two rails (31), from front to rear, and vice versa.

At the front of the unit (14), each of the two rails (31) protrudes outward from the frame (16) by an extension (33). The two parallel and substantially horizontal extensions (33) are maintained to the floor by a leg assembly (34). By virtue of the extensions (33), the cassette (22) completely leaves the frame (16) and the unit (14). The operator enters (E) and removes (O) the cassette (22) into and from its housing (29) by pushing it or by pulling it by hand and causing it to roll transversely.

The cassette (22) can then be transferred to an external mobile carriage, having a top bearing surface placed in alignment with and at the same height as the rails (31) and the extensions (33). The cassette (22) is thus transported in a maintenance workshop. For ergonomic reasons, when the machine (1) is operating in production, the assembly formed by the extensions (33) and the leg assembly (34) is folded up and nested in the frame (16) of the unit (14).

Figure 4:
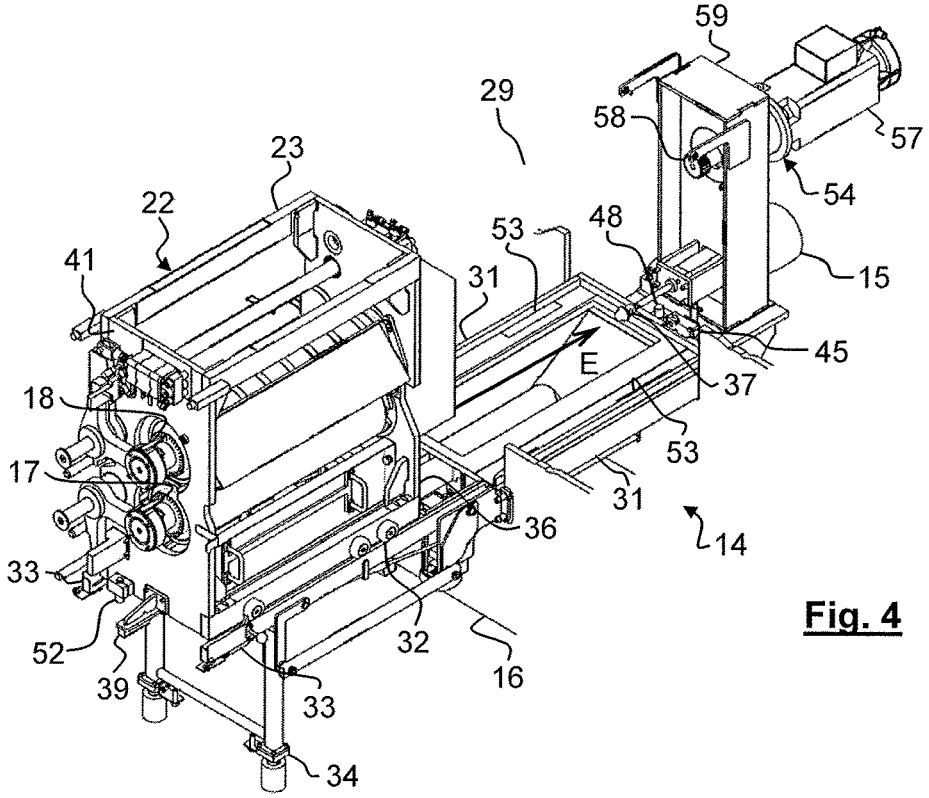
FIGS. 4 and 5 represent perspective partial cutaway views of a unit, with the cassette of FIG. 2 ready to be introduced and introduced into the unit.
Figure 5:
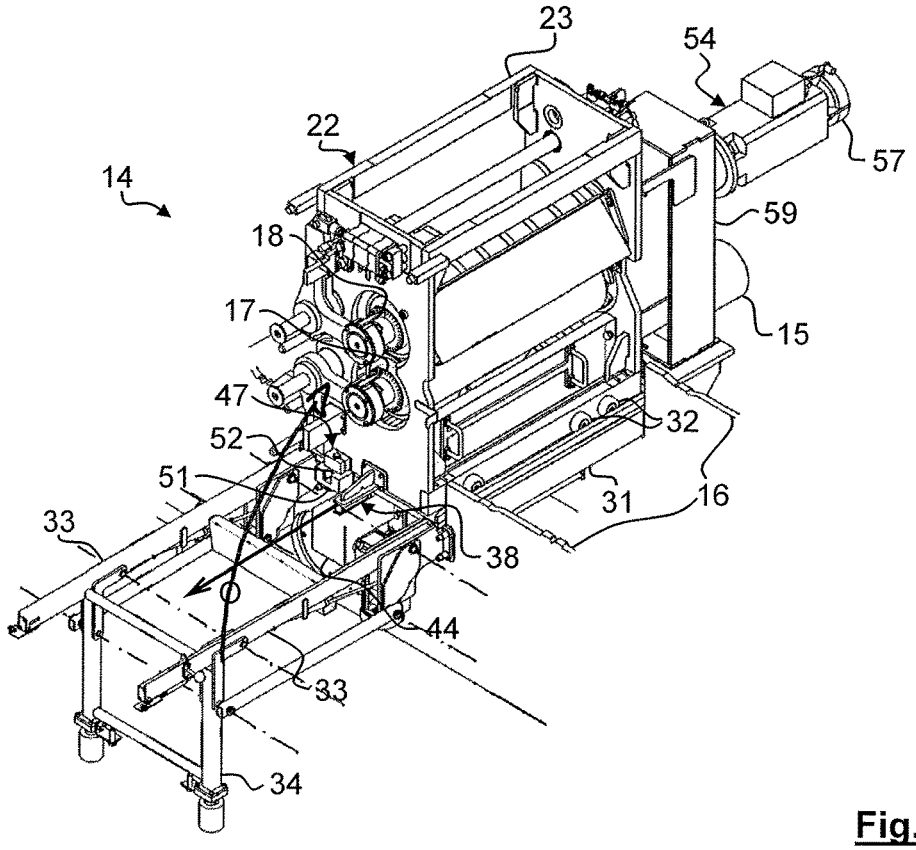

When the operator pushes the cassette (22) into its housing (29), a bottom part of the rear face (36) of its frame (23) presses against a plunger cylinder (37) which has a free end provided with a rubber bumper (see FIG. 4). The plunger cylinder (37) protrudes horizontally and perpendicularly, from the rear of the unit (14), inside a bottom portion of the housing (29).

The unit (14) may very favorably comprise transverse means (38) for displacing the cassette (22). In this position, partially introduced by hand, the transverse means (38) for displacing the cassette (22) can take over, so as to be able to fit and position the latter in its final position for its operation in the unit (14). The means (38) for displacing the cassette (22) are also used to adjust the transverse position of the cassette (22).

Figure 6:
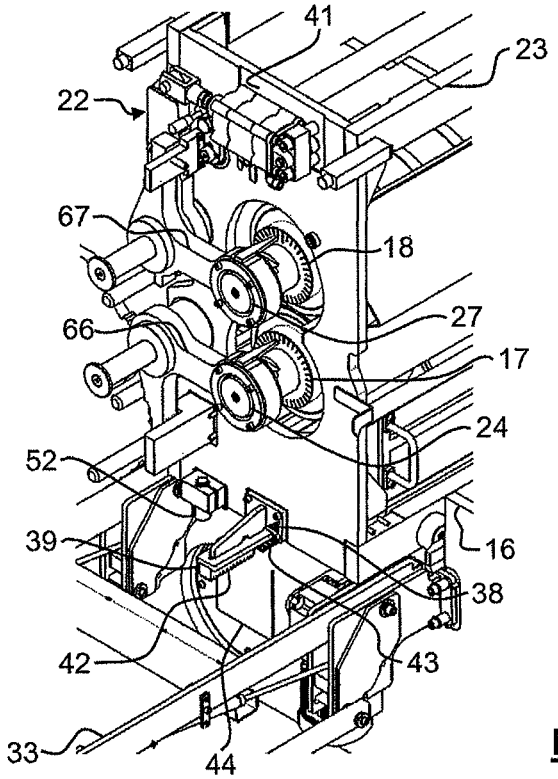
FIG. 6 represents a perspective partial cutaway view of the front of the cassette, introduced into the unit.
Figure 7:
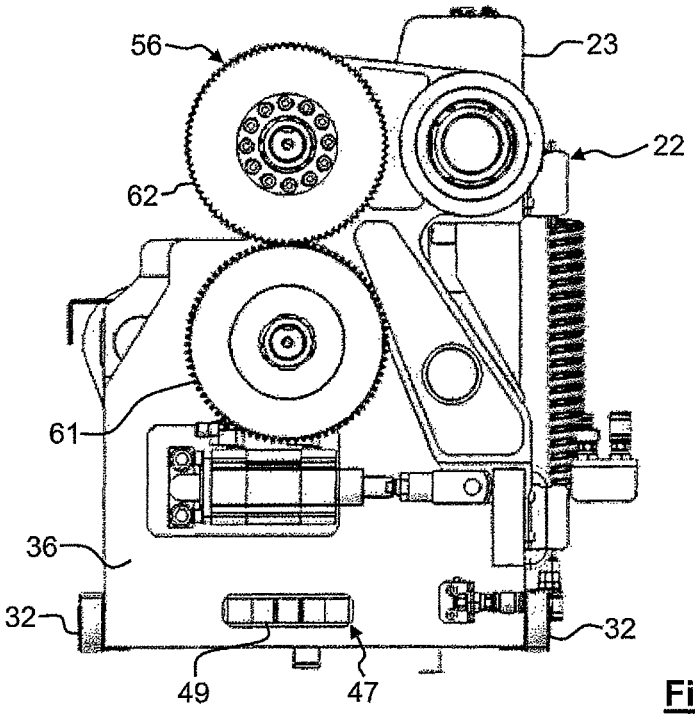
FIG. 7 represents a rear view of the cassette of FIG. 3.
Figure 8:
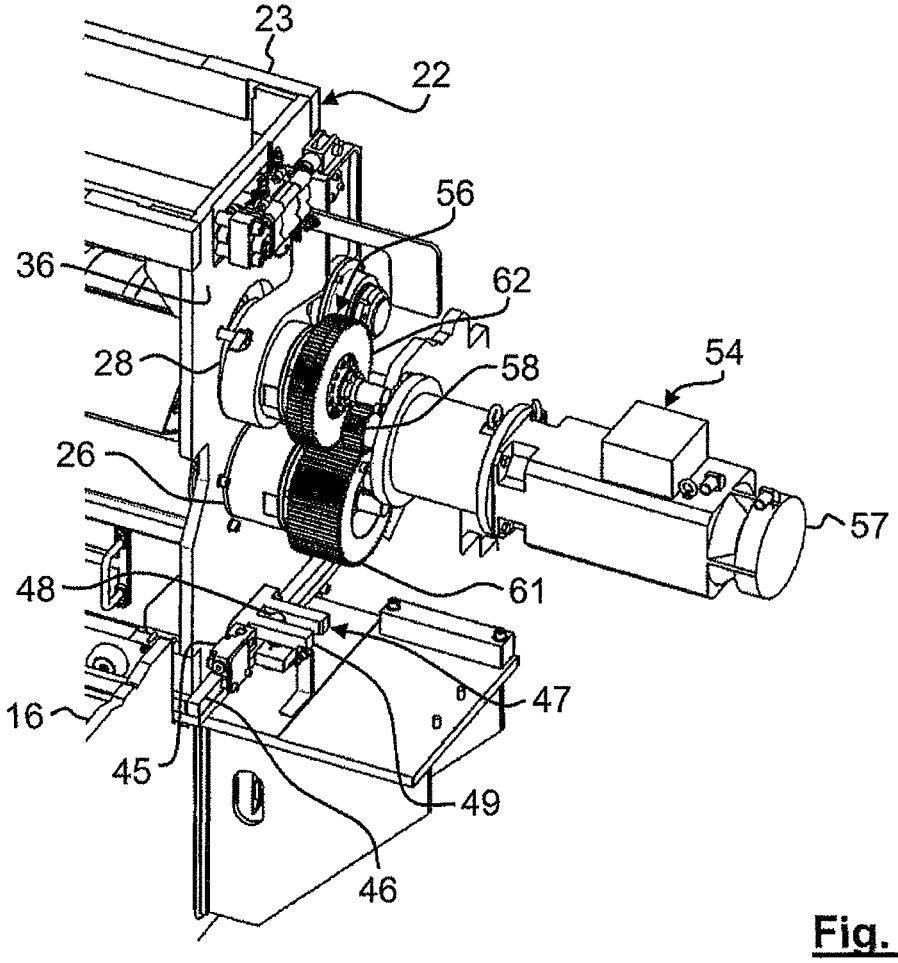
FIG. 8 represents a perspective partial cutaway view of the rear of the cassette, introduced into the unit.

As can be seen in FIG. 6, the displacement means (38) may comprise a rack (39) mounted at the cassette (22). The rack (39) takes the form of a lug which is deployed in a horizontal plane and perpendicularly from the front face (41) of the frame (23) of the cassette (22). The teeth (42) of the rack (39) are oriented downward. The rack (39) may be able to cooperate with a pinion (43), whose teeth are oriented upward and mesh with the teeth (42). The pinion (43) is driven by electric motor (44) present at the frame (16).

To finish the placement of the cassette (22) as far as the median longitudinal axis (centering system known by the name Centerline®) of the unit (14) and of the machine (1), the motor (44) will transversely drive the cassette (22) via the rack (39). For the precise adjustment or for a setting during production, according to the desired position for the waste stripping needles, the operator controls the motor (44) which will transversely drive the cassette (22) via the rack (39).

An analog cell (45) detects the transverse position of the cassette (22). A rear crossmember (46) constitutes an abutment for the maximum transverse displacement travel (E) of the cassette (22). A bottom portion of the rear face (36) of the frame (23) of the cassette (22) abuts against the rear crossmember (46).

The unit (14) includes means (47) for fixing the longitudinal position of the cassette (22), situated at the rear (FIGS. 7 and 8) and the front (FIG. 5) of the unit (14). At the rear of the unit (14), a rear pin (48) is fixed at the frame (16) and is deployed substantially vertically upward inside a bottom portion of the housing (29). A rear fork (49) extends in a horizontal plane toward the rear in the bottom portion of the housing (29), and perpendicularly from the rear face (36) of the cassette (22). The rear pin (48) engages between the two teeth of the rear fork (49).

At the front of the unit (14), a front fork (51) is fixed to the front at the frame (16) and extends upward in a vertical plane. A front pin (52) is attached at the front face (41) of the cassette (22) and is deployed substantially vertically downward. The front pin (52) engages between the two teeth of the fork (51).

The locking of the cassette (22) to the frame (16) is done first of all by fixing the pinion (41) acting on the rack (39). The locking is then done by face-to-face bearing of the bottom face of the frame (23) of the cassette (22) against the top face of the rails (31). This bearing is obtained when the small rollers (32) are engaged in grooves (53) suitably formed (see FIG. 4) in the rails (31), thus lowering and placing the cassette (22).

The unit (14) may advantageously include (see FIGS. 4, 5 and 8) driving means (54) mounted at the rear of the frame (16). These driving means for the unit (54) may be able to cooperate with conjugate driving means (56) of the cassette (22), and intended to drive the two tools (17 and 18) in rotation.

The driving means (54) of the unit (14) may preferentially (see FIGS. 4 and 7) take the form of an electric motor (57) driving a motor pinion (58). The electric motor (57) is installed on a bracket (59) attached to the frame (16) of the unit (14).

The driving means for the cassette (56) may take the form (FIGS. 3, 7 and 8) of a first pinion (61) for the first tool (17). This first pinion (61) may mesh with a second pinion (62) for the second tool (18) and with the motor pinion (58).

In the cassette (22), the first pinion (61) is already meshed with the second pinion (62). The introduction (E) of the cassette (22) causes the teeth of the first pinion (61) to engage with those of the motor pinion (58). Because of the arrangement of the second pinion (62) close to and on the same side as the motor pinion (58), the first pinion (61) has a greater thickness.

Favorably (see FIG. 2), at least one of the two tools (17 and 18), in this case the second tool (18), may be formed with a mandrel (63) and a removable sleeve (64). The sleeve (64) may be able to be inserted (arrow I in FIG. 2), fixed and driven in rotation by the mandrel (63) of the tool (17 and 18). The sleeve (64) may be able to be released, then removed (arrow R in FIG. 2).

To allow access to the mandrel (63) and the insertion (I) and the removal (R) of the sleeve (64), the bottom front bearing (24) of the bottom tool (17) is inserted into a bottom arm (66) which can move by sliding and pivoting and the top front bearing (27) of the top tool (18) is inserted into a top arm (67) which can move by sliding and pivoting.

The present invention is not limited to the embodiments described and illustrated. Numerous modifications can be made, without in any way departing from the framework defined by the scope of the set of claims.

The invention claimed is:

1. A waste stripping unit for use in a packaging production machine and positionable downstream of a cutting unit on a path of substrates, the waste stripping unit comprising a unit frame, two rotary tools parallel to each and cooperating with one another defining a gap through which the substrates move, a first one of the tools having an outer surface provided with waste stripping needles protruding radially outward from the outer surface, a removable cassette in which the two tools are mounted, the cassette comprising a cassette frame provided with bearings, located and configured for supporting the two tools such that the cassette can be introduced into the unit frame transversely of the substrate path, attached to and extracted from the unit frame transversely of the substrate path, wherein the waste stripping unit comprises two parallel and substantially horizontal rails mounted to the unit frame transversely of the substrate path, and each rail including a respective extension which in a deployed state continuously protrudes outward from the unit frame to outside the unit frame and out of the substrate path to permit entry and exit of the cassette into and outside the unit frame and in a stored state is nested in the unit frame, the extensions are maintained to the floor by a leg assembly, the extensions being parallel and substantially horizontal in the deployed state and being movable from the deployed state to the stored state, wherein said extensions of said rails and the leg assembly fold out to protrude outside of the unit frame in automatic alignment with horizontal rails inside of the frame unit to permit entry and exit of the cassette into and outside the unit frame, and are configured to be folded up and nested in the unit frame when the packaging production machine is operating in production, and wherein said unit frame is configured to receive therein said extensions of said rails when the packaging production machine is operating in production.

2. The waste stripping unit as claimed in claim 1, wherein a second one of the tools has at least one strip made of a flexible material protruding radially outward from the second tool.

3. The waste stripping unit as claimed in any one of the in claim 1, wherein at least one of the two tools comprises a mandrel and a removable sleeve, which is inserted on, fixed to and driven in rotation by the mandrel.

4. The waste stripping unit as claimed in claim 1, further comprising a first driving device for the waste stripping unit, which is mounted at a rear of the unit frame for cooperating with a second driving device for the cassette, and the first and second driving device, together drive the two tools in rotation.

5. The waste stripping unit as claimed in claim 4, wherein the first driving device for the unit comprises an electric motor and a motor pinion thereon, and the second driving device for the cassette comprises a first pinion for driving rotation of the first tool, the first pinion meshing with a second pinion for driving the second tool and also meshing with the motor pinion.

6. The waste stripping unit as claimed in claim 1, further comprising a device for displacing the cassette transversely.

7. The waste stripping unit as claimed in claim 6, wherein the displacement device comprises a rack mounted at the cassette and the rack is located and configured to mesh with a pinion driven by a motor at the unit frame.

8. The waste stripping unit as claimed in claim 1, further comprising a first transport assembly for transporting the flat substrate and placed upstream of the cassette, and a second transport assembly for transporting the flat substrate, and placed downstream of the cassette, the first and the second transport assemblies being mounted in the unit frame.

9. A packaging production machine, which comprises a cutting unit for cutting substrates and the waste stripping unit as claimed in claim 1, the stripping unit is positioned downstream of the cutting unit on the path of the substrates.

10. The machine as claimed in claim 9, which comprises, in order, from upstream to downstream on the path of the substrates, the cutting unit comprising a diecutting platen press for cutting the substrates, a driving arrangement for the cut substrates, a transfer device, a first vacuum transport for the cut substrates, the unit, and a second vacuum transport for the cut substrates.

* * * * *